US005131422A

United States Patent [19]

Aronov

[11] Patent Number: 5,131,422

[45] Date of Patent: Jul. 21, 1992

[54] DEVICE FOR PROTECTING AN UMBRELLA AGAINST INVERSION

[76] Inventor: Victor Aronov, 8620 Waukegan Rd., Morton Grove, Ill. 60053

[21] Appl. No.: 668,073

[22] Filed: Mar. 12, 1991

[51] Int. Cl.[5] ..... A45B 25/02

[52] U.S. Cl. ..... 135/27; 135/33.5; 135/37

[58] Field of Search ..... 135/27, 23, 37, 15.1, 135/16, 33.5

[56] References Cited

U.S. PATENT DOCUMENTS

| | | | |
|---|---|---|---|
| 122,453 | 1/1872 | Gossip . | |
| 161,962 | 4/1875 | Horton . | |
| 360,294 | 3/1887 | Hartz | 135/27 |
| 438,983 | 10/1890 | Bergensen | 135/27 X |
| 539,762 | 5/1895 | Barnett | 135/27 |
| 540,098 | 5/1895 | Grove et al. | 135/27 X |
| 597,717 | 1/1898 | Illoway . | |
| 773,499 | 10/1904 | Hirsch et al. | 135/27 |
| 850,341 | 4/1907 | Callahan | 135/27 |
| 1,378,354 | 5/1921 | Johnson | 135/27 X |
| 2,114,598 | 4/1938 | Grissel . | |
| 2,465,140 | 3/1949 | Vila . | |
| 3,032,047 | 5/1962 | Wendorf . | |
| 3,042,055 | 7/1962 | Todorovic . | |
| 4,300,582 | 11/1981 | Desarno . | |
| 4,407,317 | 10/1983 | Crandall | 135/27 |

FOREIGN PATENT DOCUMENTS

| | | | |
|---|---|---|---|
| 667280 | 11/1938 | Fed. Rep. of Germany | 135/27 |

*Primary Examiner*—David A. Scherbel
*Assistant Examiner*—Lan Mai
*Attorney, Agent, or Firm*—Willian Brinks Olds Hofer Gilson & Lione

[57] ABSTRACT

An umbrella includes a substantially inextensible cord which is mounted by couplers to the free ends of the ribs of the umbrella such that the cord forms a closed loop disposed radially inwardly of the ribs of the umbrella. The cord braces the umbrella against inversion, and the couplers can be designed to allow the cord to be retrofitted to an existing umbrella.

21 Claims, 3 Drawing Sheets

FIG. 1
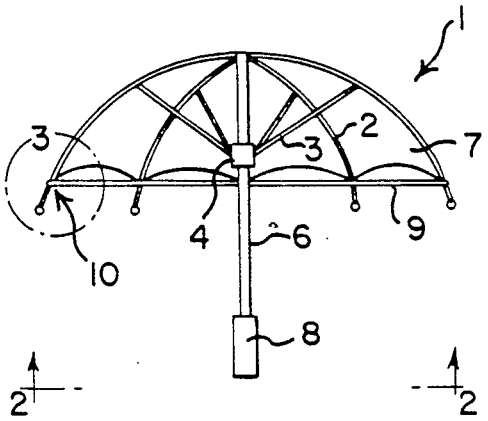
FIG. 2
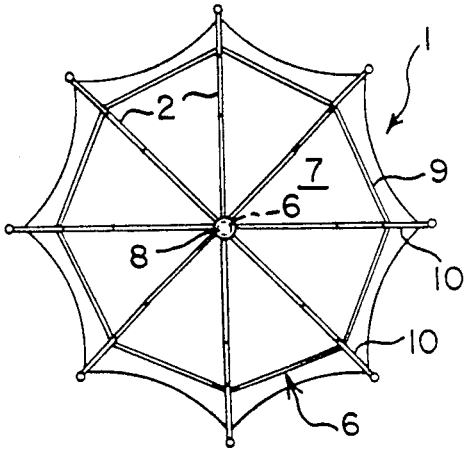
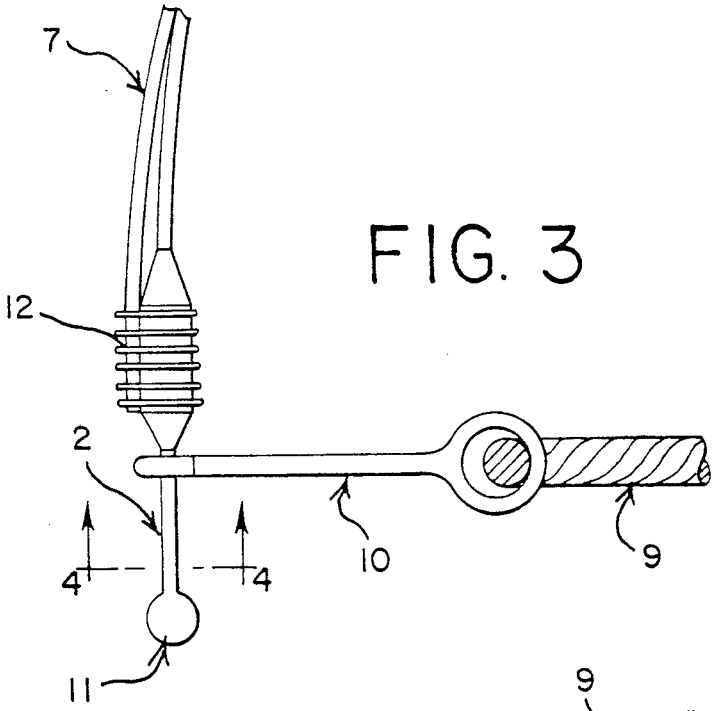
FIG. 3
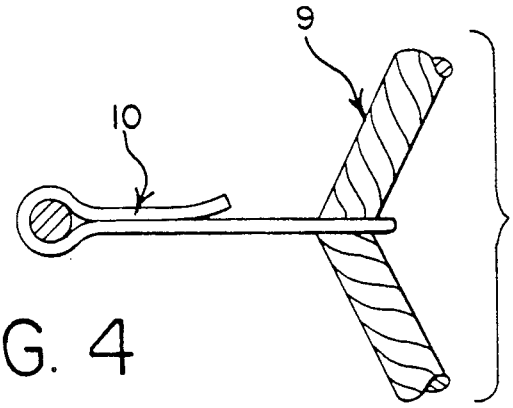
FIG. 4

DEVICE FOR PROTECTING AN UMBRELLA AGAINST INVERSION

BACKGROUND OF INVENTION

This invention relates to umbrellas, and in particular to a device for protecting an umbrella against wind damage.

Umbrella design is typically driven by the requirement that the umbrella must be light in weight, and commonly used umbrella structures are relatively flexible. For this reason many umbrellas, particularly those of the collapsible kind, have a tendency to collapse from the inside out in response to excessive wind loads.

There have been a number of previous approaches to improving the resistance of an umbrella to inversion, as described in the following U.S. Patents:

| | |
|---|---|
| Desarno | 4,300,582 |
| Todorovic | 3,042,055 |
| Wendorf | 3,032,047 |
| Vila | 2,465,140 |
| Grissel | 2,114,598 |
| Illoway | 597,717 |
| Horton | 161,962 |
| Gossip | 122,453 |

These patents disclose various types of reinforcing cords, tapes or the like designed to resist the tendency of an umbrella to invert when subjected to a high wind load. In all of these patents other than the Desarno and Todorovic patents, the cord or tape is placed in the plane of the canopy. This arrangement provides disadvantages as described below. In the Desarno patent the cord is placed radially inward of the canopy. However, the cord is secured both to the canopy and to the ribs of the umbrella. This arrangement is not well-suited for a fixture that can be retrofitted easily to an existing umbrella, and it restricts movement of the canopy when the umbrella is folded.

The present invention is directed to an improved device for protecting an umbrella against inversion, which strengthens the umbrella against inversion without interfering with normal movement of the canopy, and which, in the preferred embodiments described below, can easily be retrofitted to an existing umbrella.

SUMMARY OF THE INVENTION

According to this invention, a plurality of couplers are provided, each secured to a respective one of the umbrella ribs to extend inwardly from the umbrella canopy toward the umbrella shaft. A tension member such as a cord is secured to the couplers to pass between the ribs and to form a closed loop having a length selected to brace the ribs against inversion. The tension member is disposed inwardly of the ribs, between the ribs and the shaft, when the umbrella is opened, and the canopy is free to move independently of the tension member between the couplers.

BRIEF DESCRIPTION OF THE DRAWINGS

FIG. 1 is an elevational view in partial cutaway of an umbrella which incorporates a first preferred embodiment of this invention.

FIG. 2 is a bottom view taken along line 2—2 of FIG. 1.

FIG. 3 is an enlarged view of a portion of the embodiment of FIG. 1 within the illustrated circle.

FIG. 4 is a sectional view taken along line 4—4 of FIG. 3.

DETAILED DESCRIPTION OF THE PRESENTLY PREFERRED EMBODIMENTS

Figure 5:
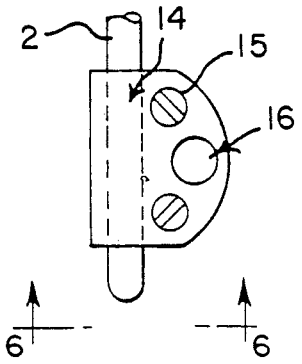
FIG. 5 is a plan view of a portion of a second preferred embodiment of this invention.
Figure 6:
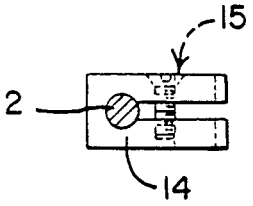
FIG. 6 is an end view taken along line 6—6 of FIG. 5.

Turning now to the drawings, FIGS. 1 and 2 show general views of an umbrella 1 having a central shaft 6 on which is slidably mounted an annular bushing 4. A plurality of ribs 2 are pivotably mounted to the central shaft 6 to move between the open position shown in FIGS. 1 and 2 and a closed position (not shown) in which the ribs 2 are positioned alongside the shaft 6. Intermediate ribs 3 extend between the ribs 2 and the bushing 4 and are used to hold the ribs 2 in the opened position of FIGS. 1 and 2. A canopy 7 is secured to the ribs 2 in the conventional manner, and a conventional handle 8 is mounted at one end of the shaft 6. The elements of the umbrella 1 described above are conventional in the art, and do not per se form part of this invention. Depending upon the application, the umbrella 1 can be of the collapsible type, in which the shaft 6 is designed to telescope, or it can alternately be of the fixed length type. A wide variety of designs can be used for the detailed structure of the ribs 2, 3, and a wide variety of materials can be used.

According to this invention, a tension member such as a cord 9 is secured by means of couplers 10 to the free ends of the ribs 2. As best shown in FIG. 2, the cord 9 forms a closed loop which is disposed radially inwardly from the ribs 2, between the ribs 2 and the shaft 6.

FIGS. 3 and 4 are enlarged fragmentary views that illustrate a first preferred arrangement for connecting the cord 9 to the ribs 2. As shown in these figures, each of the couplers 10 is a clip having an eye at one end through which the cord 9 passes and a hook at the other end. The rib 2 in this embodiment has an enlarged end 11 at the free end, and the canopy 7 is secured to the rib 2 by stitches 12. The hook portion of the coupler 10 is designed to fit around the rib 2 in the region between the enlarged end 11 and the stitches 12. The diameter of the opening in the hook end of the coupler 10 is smaller than both the enlarged end 11 and the portion of the rib 2 receiving the stitches 12. Thus, when the coupler 10 is installed as shown in FIG. 3, the coupler 10 is captured on the free end of the rib 2, and is positively prevented from sliding off the end of the rib, or sliding up the rib toward the shaft 6. In this embodiment, the coupler 10 is installed on the ribs 2 by separating the opposed portions of the hook end of the coupler 10 until the rib 2 can be inserted into the hook end. In this embodiment the coupler 10 is preferably formed of a spring steel which biases the coupler 10 into the position shown in FIG. 4, in which the rib 2 is positively captured in the hook.

The cord 9 is preferably light in weight, small in diameter, and substantially inextensible.

The coupler 10 can take various alternative forms, depending on the application. For example, as shown in FIG. 5, the cord may be releasably engaged on the rib 2 by means of a clamp 14 which defines an opening 16 sized to receive the cord. A pair of threaded fasteners 15 are used to lock the two sides of the clamp 14 together, thereby releasably securing the clamp 14 on the rib 2.

Figure 7:
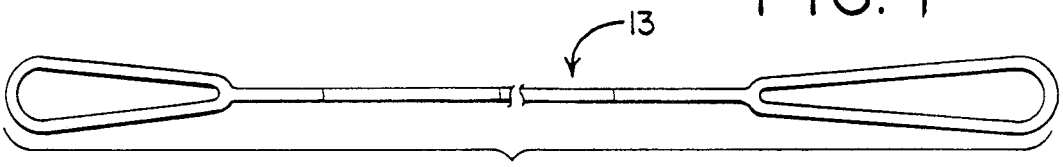
FIG. 7 is a plan view of a portion of a third preferred embodiment of this invention.

FIG. 7 shows a third preferred embodiment of a coupler 13 for securing the cord to the ribs. The coupler 13 is formed of a resilient material such as a suitable plastic or elastomer, and it defines two eyes, one at each end. The smaller eye may be passed through the larger eye to form a loop to receive the cord 9, and the smaller eye is sized to slip over the enlarged end of the rib to hold the coupler 13 in position on the rib.

The embodiments described above can either be incorporated into the umbrella at the time of manufacture, or they can be retrofitted to an existing umbrella. In either case, it may be desirable to provide a means for varying or adjusting the length of the cord 9. Two suitable approaches for accomplishing this function are shown in FIGS. 8-10.

Figure 8:
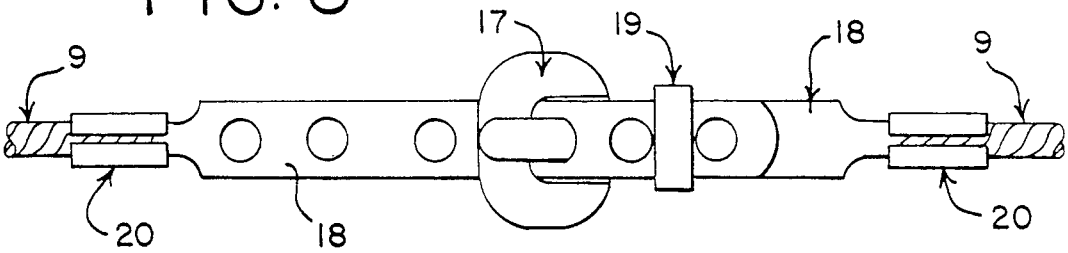
FIG. 8 is a plan view of a length adjusting mechanism suitable for use with the embodiment of FIG. 1.

In FIG. 8 each end of the cord 9 is coupled to a respective belt 18 by a connecting sleeve 20. One of the belts 18 supports a buckle 17 and a retaining loop 19. The other of the belts 18 defines a number of openings. The buckle 17 can be used to adjust the effective length of the cord 9.

Figure 9:
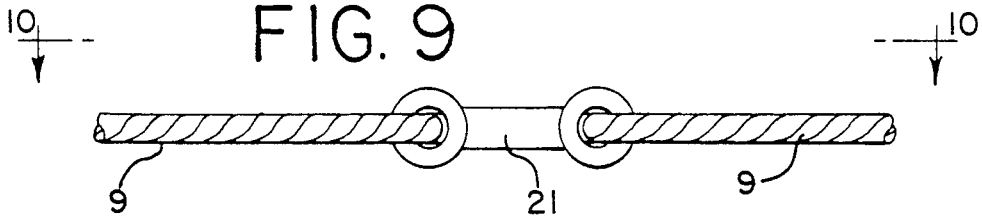
FIG. 9 is a plan view of an alternative length adjusting mechanism suitable for use with the embodiment of FIG. 1.
Figure 10:
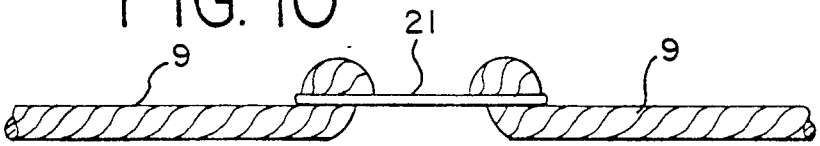
FIG. 10 is a view taken along line 10—10 of FIG. 9.

An alternate arrangement is shown in FIGS. 9 and 10, in which a plate 21 is provided with a pair of openings, each of which receives a respective free end of the cord 9. The ends of the cord 9 are provided with knots as shown in FIG. 10, which are larger in diameter than the diameters of the corresponding openings in the plate 21. By properly positioning the knots the effective length of the cord 9 can be adjusted. As yet another alternate, the two ends of the cord 9 may be simply knotted together to create the desired effective length for the closed loop.

Simply by way of example, braided rayon of the type supplied by Textile Craft Co. as part no. 5-5-3 has been found suitable for the cord 9, and a length of 3 to 3.5 inches has been found suitable for the coupler 10.

In operation, the cord 9 and the couplers 10 increase the stability of the umbrella 1, and its resistance to inversion. In high winds, pressure is applied to the underside of the canopy 7 in such a way as to tend to invert the canopy 7. If this wind pressure is uniformly distributed, it will tend to move the ribs outwardly. At some critical value of wind pressure, the ribs will invert. If wind pressure is not uniform, the ribs will move asymmetrically such that the ribs on one side of the umbrella deflect inwardly, and the ribs on the other side of the umbrella deflect outwardly. Such asymmetrical deflection may become so large that a few of the ribs may collapse and invert, thereby damaging the rest of the umbrella structure.

The cord 9 is preferably adjusted so as to provide a preload on the ribs 2 causing them to deflect somewhat inwardly of their rest position. During high winds when pressure is applied to the underside of the canopy 7, the preloaded ribs provide increased resistance to inversion. As shown in FIG. 2, the perimeter of the closed loop defined by the cord 9 (an octagon in this particular embodiment) is smaller than the perimeter of the edge of the canopy 7. For this reason, considerable stretching of the cord 9 would be required before the umbrella 1 could invert, and in this way the umbrella 1 is protected against inversion.

Figure 11:
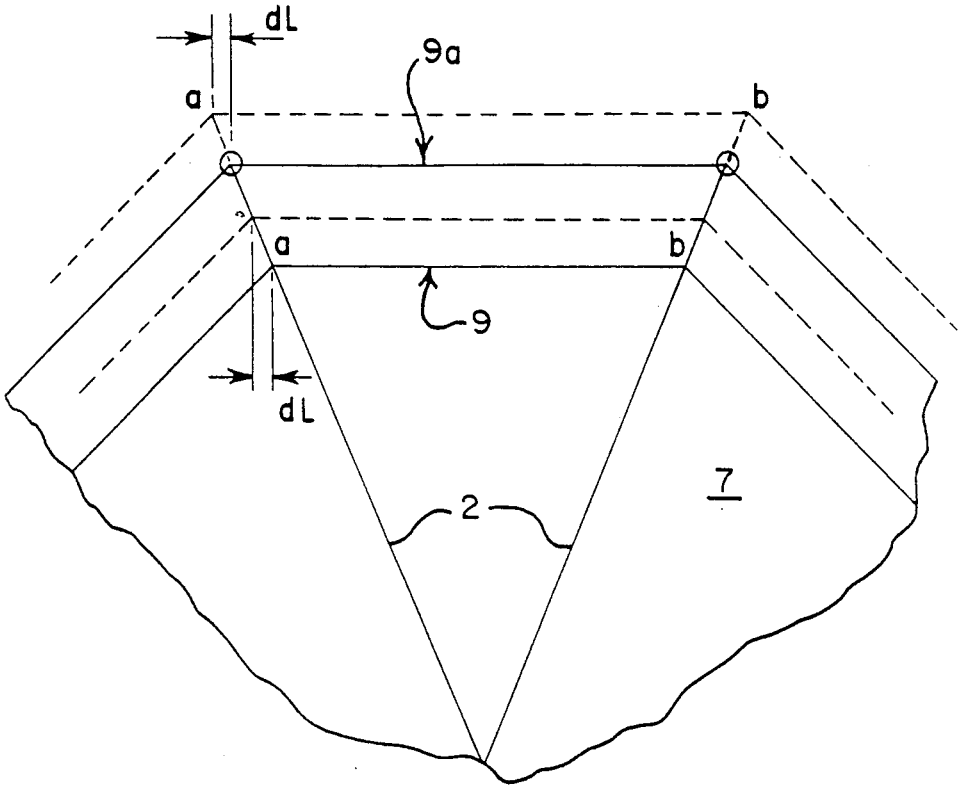
FIG. 11 is a schematic representation of a portion of the embodiment of FIG. 1 showing movement of the umbrella under symmetrical wind loading.

As shown in FIG. 11, the cord 9 is disposed radially inwardly of the tips of the ribs 2. For purposes of illustration, FIG. 11 shows an additional cord (cord **9*a*), which is positioned near the tips of ribs 2, and is therefore disposed radially outwardly of the cord 9. Of course, the cord 9*a* has a length greater than that of the cord 9, as is clear from FIG. 11**.

If wind pressure on the inside of the canopy 7 is symmetrical, the ribs 2 will tend to move along the lines a—a and b—b. The deflected position of the cords 9, **9*a* is shown in dashed lines in FIG. 11. Both cords are moved by the same distance and, as shown in FIG. 11, this movement will cause each of the cords 9, 9*a*** to elongate by the same amount dL. Assuming linear material properties, the stress in the cord S is equal to Ee, where E is the modulus of elasticity of the cord, and e is the strain This equation can be rewritten in terms of load and cord length as follows:

$$N = AE(dL/L)$$

where N is load along the cord, A is the cross-sectional area of the cord, dL is the increase in the cord length due to elongation as described above, and L is the initial cord length. If both cords 9, **9*a* are made of the same material, then the product AE is equal to a constant C. The above equation can then be written for the cord 9*a*** as follows:

$$N1 = C(dL/L1)$$

Similarly, the above equation can be rewritten for the cord 9 as follows:

$$N2 = C(dL/L2)$$

In this example, L1 is larger than L2, and N2 is therefore larger than N1. In other words, to stretch a shorter cord by the same amount as a longer cord requires a larger load to be applied to the shorter cord. This means that the shorter cord 9 as used in the embodiment described above will resist a larger load (i.e. a stronger wind) before the ribs 2 are deflected to the point where they can invert.

Figure 12:
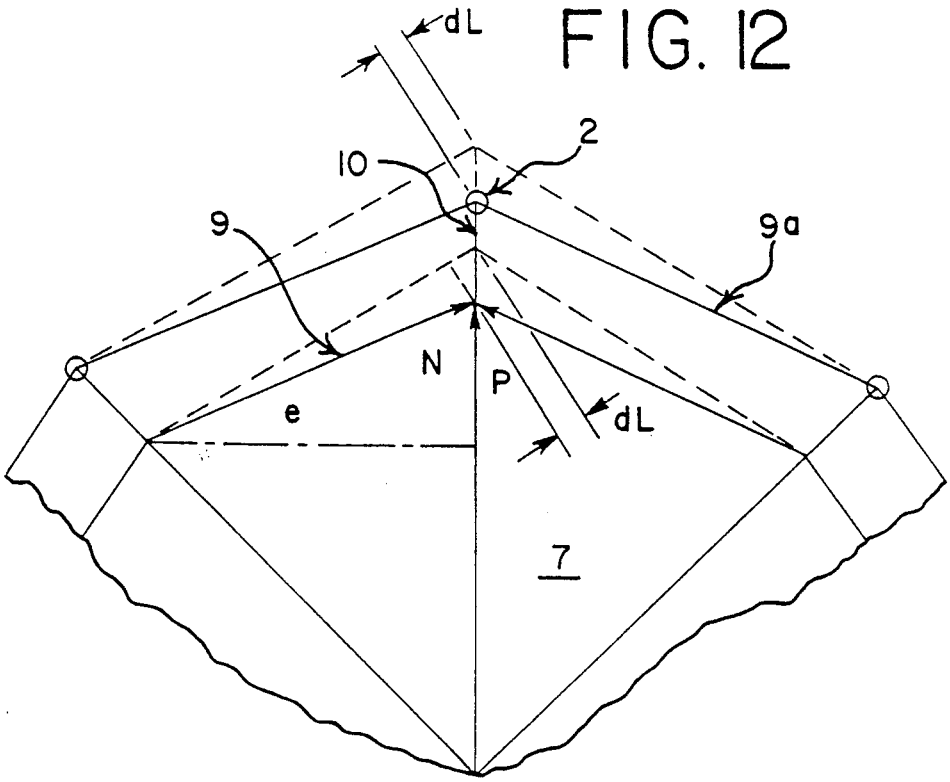
FIG. 12 is a schematic representation of a portion of the embodiment of FIG. 1 showing asymmetrical deformation of the umbrella under wind loading.

FIG. 12 illustrates movement of the cords 9, **9*a* in the event of asymmetrical wind loading. In this case, one or more of the ribs will experience a load which is larger by the amount P than the others. Due to this increased load, the rib will tend to move outwardly, causing equal elongation dL of the cords 9 and 9*a*. Due to the fact that the cord 9*a* is longer than the cord 9, a smaller load N is required to cause the elongation dL in the cord 9*a* than in the cord 9, in a manner similar to that described above in connection with FIG. 11**.

The load N on the cord 9 is equal to P/sin(e) where e is an angle as shown in FIG. 12. A relatively smaller angle results in a larger load N. For an octagonal configuration (an umbrella with eight ribs) the angle e is equal to 22.5°, and N is larger than P by a factor of 2.6. This effect, combined with the fact that the length of the connector is much smaller than the length of the cord 9, indicates that elongation of the connector 10 is a negligible contribution to the total deflection of the structure.

When the wind pressure on the inside of the canopy 7 is not uniform, the resistance of the ribs 2 to inversion is increased by the opposite deflection of the opposing ribs. This means that when the rib 2 of FIG. 12 moves outwardly, all of the ribs of the umbrella will be deflected. Thus, even if the cord 9 is made of ideally rigid material, the rib 2 of FIG. 12 may deflect outwardly, causing deflection of the entire structure. This tendency can be resisted by adjusting the perimeter of the cord 9 to a smaller length. When this is done, a load directed oppositely to the load P will be applied to all of the ribs, causing them to be deflected radially inwardly. Uneven pressure applied to the underside of the canopy 9 as shown in FIG. 12 will be opposed by an increased resistance due to the fact that this motion will require further deflection of an already preloaded structure.

From the foregoing discussion, it should be apparent that important advantages are obtained by placing the cord radially inwardly of the ribs. Furthermore, these advantages are obtained without interfering with the free movement of the canopy 7 when the umbrella is folded. For example, the portions of the canopy 7 intermediate the ribs are free to fold outwardly when the umbrella is folded, and thus the cord 9 does not interfere with normal operation of the umbrella.

Of course, a range of changes and modifications can be made to the preferred embodiments described above. For example, the coupler 10 may take various other forms, including link or bead chains having hooks and eyes on both ends. A variety of materials can be used such as steel, bronze, aluminum or a suitable plastic material, and, of course, various decorative coatings can be used as desired. The cord 9 may be made of various materials such as silk, nylon or even wire rope.

Additionally, it is not always required to provide means for adjusting the length of cord 9. For example, the ends of the cord 9 can be secured together by permanently installed sleeves similar to the sleeves 20 in FIG. 8. In this case, the length of the cord should be selected in such a way as to ensure proper preloading of the ribs 2. The couplers 10 may be designed for permanent installation on the ribs 2, or they may be designed to be detachable from the ribs 2.

It is therefore intended that the foregoing detailed description be regarded as illustrative rather than limiting, and that it be understood that it is the following claims, including all equivalents, which are intended to define the scope of this invention.

I claim:

1. In an umbrella of the type having a shaft, an array of ribs pivotably mounted to the shaft, and a flexible canopy mounted to the ribs, the improvement comprising:

a plurality of couplers, each secured to a respective one of the ribs to extend inwardly from the canopy toward the shaft;

a tension member secured to the couplers to pass between the ribs to form a closed loop having a length selected to brace the ribs against inversion;

said tension member disposed inwardly of the ribs, between the ribs and the shaft, and said tension member disposed inwardly of and separated from the canopy between the ribs when the umbrella is opened; and said canopy being free to move independently of the tension member between the couplers.

2. The invention of claim 1 wherein the tension member comprises a flexible cord.

3. The invention of claim 1 wherein each of the ribs defines a free end, and wherein the couplers are mounted to the ribs adjacent the free ends.

4. The invention of claim 1 wherein each of the couplers comprises means for releasably and detachably securing the coupler to the respective rib.

5. The invention of claim 4 wherein the releasably securing means comprises an element configured to surround the rib and means for releasably holding the element in position on the rib.

6. The invention of claim 5 wherein the releasably holding means comprises a threaded fastener.

7. The invention of claim 5 wherein the releasably holding means comprises a metallic spring included in the element.

8. The invention of claim 5 wherein the releasably holding means comprises an elastomeric portion included in the element.

9. The invention of claim 1 further comprising means for adjusting the length of the tension member to control the perimeter of the closed loop.

10. The invention of claim 9 wherein the adjusting means comprises a buckle.

11. The invention of claim 9 wherein the adjusting means comprises a plate having a pair of openings, wherein the tension member defines two end portions, and wherein each of the end portions is secured to the plate at a respective one of the openings.

12. The invention of claim 1 wherein the tension member is dimensioned to pre-tension the ribs when the umbrella is opened.

13. In an umbrella of the type having a shaft, an array of ribs pivotably mounted to the shaft, and a flexible canopy mounted to the ribs, the improvement comprising:

a plurality of releasable couplers, each releasably and detachably secured to a respective one of the ribs adjacent a free end of the respective rib, each coupler defining a cord receiving opening, said cord receiving openings disposed radially inwardly of the canopy, between the ribs and the shaft;

a cord which passes through the cord receiving openings of the couplers to form a closed loop having a length selected to brace the ribs again inversion;

said cord disposed inwardly of the ribs, between the ribs and the shaft, when the umbrella is opened; and said cord coupled to the umbrella only at the couplers such that the canopy is free to move independently of the cord between the ribs.

14. The invention of claim 13 wherein each of the couplers comprises an element configured to surround the rib and means for releasably holding the element in position on the rib.

15. The invention of claim 14 wherein the releasably holding means comprises a threaded fastener.

16. The invention of claim 14 wherein the releasably holding means comprises a metallic spring included in the element.

17. The invention of claim 14 wherein the releasably holding means comprises an elastomeric portion included in the element.

18. The invention of claim 13 further comprising means for adjusting the length of the cord to control the perimeter of the closed loop.

19. The invention of claim 18 wherein the adjusting means comprises a buckle.

20. The invention of claim 18 wherein the adjusting means comprises a plate having a pair of openings, wherein the cord defines two end portions, and wherein each of the end portions is secured to the plate at a respective one of the openings.

21. The invention of claim 13 where the cord is dimensioned to pre-tension the ribs when the umbrella is opened.

* * * * *

UNITED STATES PATENT AND TRADEMARK OFFICE

CERTIFICATE OF CORRECTION

PATENT NO. : 5,131,422

DATED : July 21, 1992

INVENTOR(S) : Victor Aronov

It is certified that error appears in the above-identified patent and that said Letters Patent is hereby corrected as shown below:

Column 4, line 24, after "strain" insert --.--.

Column 6,

Claim 13, line 48, delete "again" and substitute therefor --against--.

Signed and Sealed this

Eighteenth Day of January, 1994

*Attest:*

Bruce Lehman

BRUCE LEHMAN

*Attesting Officer*

*Commissioner of Patents and Trademarks*